United States Patent [19]

Cheung

[11] Patent Number: 4,647,299

[45] Date of Patent: Mar. 3, 1987

[54] PROCESS TO PRODUCE AN OXYGEN-FREE KRYPTON-XENON CONCENTRATE

[75] Inventor: Harry Cheung, Buffalo, N.Y.

[73] Assignee: Union Carbide Corporation, Danbury, Conn.

[21] Appl. No.: 641,220

[22] Filed: Aug. 16, 1984

[51] Int. Cl.[4] ..... F25J 3/04

[52] U.S. Cl. ..... 62/22; 55/66; 62/28; 62/31; 62/34; 423/262

[58] Field of Search ..... 62/22, 28, 31, 34; 55/66; 423/262

[56] References Cited

U.S. PATENT DOCUMENTS

| | | | |
|---|---|---|---|
| 3,191,393 | 6/1965 | Dennis | 62/22 |
| 3,596,471 | 8/1971 | Streich | 62/22 |
| 3,609,983 | 10/1971 | Lofredo et al. | 62/22 |
| 3,751,934 | 8/1973 | Frischbier | 62/41 |
| 3,768,270 | 10/1973 | Shuftan | 62/31 |
| 3,779,028 | 12/1973 | Shuftan et al. | 62/22 |
| 4,384,876 | 5/1983 | Mori et al. | 62/22 |
| 4,401,448 | 8/1983 | LaClair | 62/22 |
| 4,421,536 | 12/1983 | Mori et al. | 62/18 |

*Primary Examiner*—Ronald C. Capossela
*Attorney, Agent, or Firm*—Stanley Ktorides

[57] ABSTRACT

A method to concentrate krypton and xenon in a substantially oxygen-free liquid employing a two-section exchange column, the top section of which is refluxed by a substantially rare gas-free liquid.

18 Claims, 1 Drawing Figure

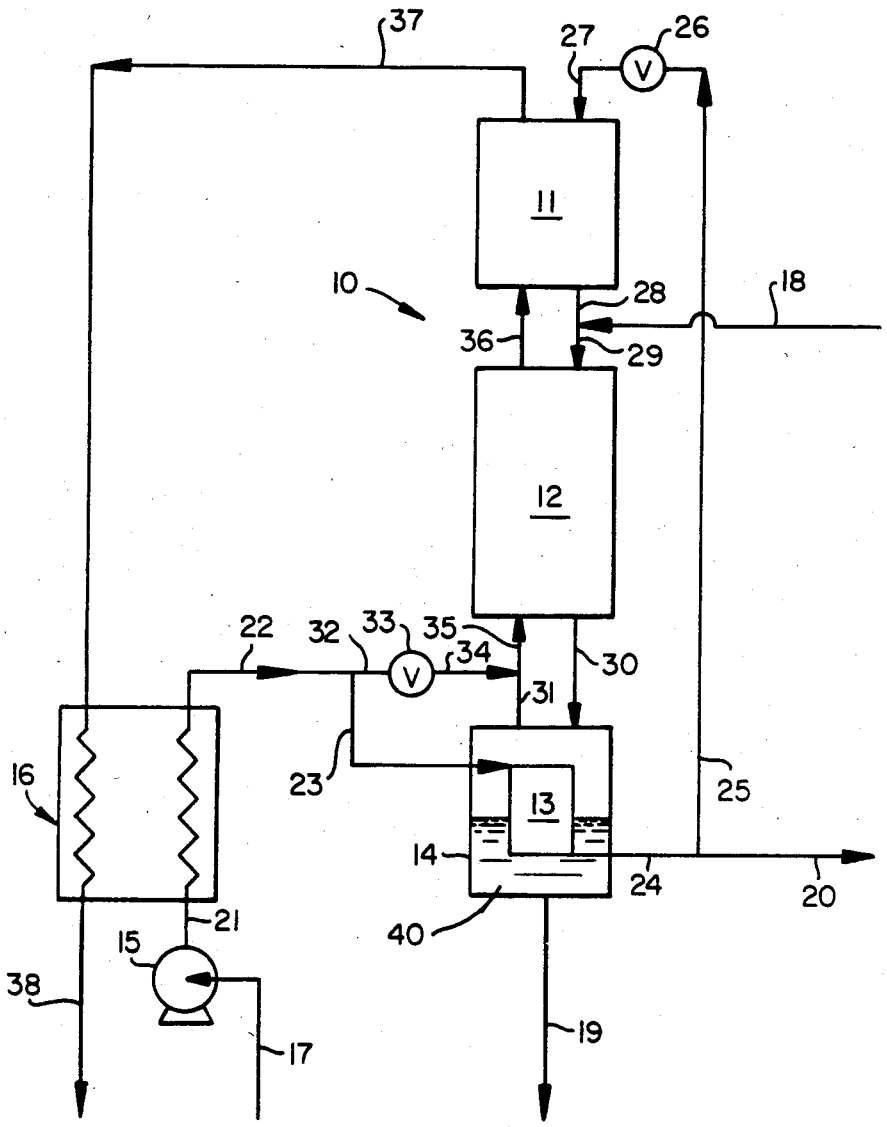
37
27
26
V
11
10
28
18
36
29
12
22
32
33
35
34
V
30
31
16
23
13
25
14
24
20
21
40
15
38
17
19

PROCESS TO PRODUCE AN OXYGEN-FREE KRYPTON-XENON CONCENTRATE

TECHNICAL FIELD

This invention relates to the production of an oxygen-free krypton-xenon concentrate and is an improvement whereby substantially all of the krypton and xenon in the feed is recovered in the concentrate.

BACKGROUND ART

Krypton and xenon are undergoing increasing demand in a number of applications. Krypton is being widely used in high quality lighting including long-life light bulbs and automotive lamps. Xenon is being used for medical applications including special x-ray equipment. Both of these gases are commonly used in many laboratory and research applications.

The principle source of krypton and xenon is the atmosphere. Atmospheric air contains about 1.1 ppm (parts per million) of krypton and about 0.08 ppm of xenon. Generally, krypton and xenon are recovered from air in conjunction with a comprehensive air separation process which separates air into oxygen and nitrogen.

At the heart of krypton and xenon recovery processes is the fact that krypton and xenon have lower vapor pressures than the major atmospheric gases. This allows their concentration, in vapor-liquid countercurrent distillation processes, to increase to the point where recovery is economically viable. The krypton and xenon concentrate in the oxygen component rather than the nitrogen component because oxygen has a lower vapor pressure than nitrogen. Unfortunately these processes also unavoidably concentrate atmospheric hydrocarbons which are also characterized by lower vapor pressures than the major atmospheric gases, thus giving rise to an increased danger of explosion.

A recent attempt to address this problem is disclosed in U.S. Pat. No. 4,401,448-LaClair, wherein the oxygen component in the krypton-xenon concentrate is replaced by non-combustible nitrogen thus markedly reducing dangerous conditions. Although the process disclosed in the aforementioned patent successfully exchanges oxygen with nitrogen in the rare gas concentrate, it does not recover all of the krypton and xenon in the original oxygen-containing concentrate, thus requiring either a loss of some of the rare gas or, alternatively, a return of the waste stream to an air separation plant for further processing to recover the krypton and xenon. This alternative is undesirable for two reasons. First, krypton and xenon, which had already been concentrated must be remixed with the fluids in the air separation plant and again undergo rectification, resulting in added costs. Second, the krypton-xenon concentration process must necessarily be close to, and operated in conjunction with, the comprehensive air separation plant, resulting in loss of flexibility and possibly higher costs.

Accordingly, it is an object of this invention to provide an improved process to produce a krypton-xenon concentrate in an oxygen-free medium.

It is another object of this invention to provide an improved process to produce a krypton-xenon concentrate in an oxygen-free medium wherein substantially all of the krypton and xenon which enters the process is recovered in the concentrate.

It is a further object of this invention to provide an improved process to produce a krypton-xenon concentrate in an oxygen-free medium which can be operated economically independently of a cryogenic air separation plant.

SUMMARY OF THE INVENTION

The above and other objects which will become apparent to one skilled in the art upon a reading of this specification are attained by this invention which is:

A method for processing a liquid feed comprising krypton, xenon and oxygen to produce krypton and xenon concentrated in a substantially oxygen-free medium whereby substantially all of the krypton and xenon in the feed is concentrated in said medium comprising:

(1) introducing a feed liquid comprising oxygen, krypton and xenon into an exchange column at an intermediate point of the column for downward flow through the column;

(2) introducing vapor, having a low concentration of oxygen and rare gases, into said exchange column at a point below said intermediate point to form upflowing exchange vapor;

(3) introducing substantially rare gas-free liquid into said column at a point above said intermediate point to form downflowing reflux liquid;

(4) passing the upflowing vapor against the downflowing liquids to exchange oxygen from the downflowing liquids to the upflowing vapor and non-oxygen medium from the upflowing vapor to the downflowing liquids;

(5) passing the oxygen-containing upflowing vapor against downflowing liquid reflux whereby krypton and xenon which may have passed to the upflowing vapor during step (4) are transferred into downflowing liquid;

(6) removing from the exchange column the oxygen-containing vapor substantially free of rare gases;

(7) passing the downflowing liquids to a reboiling zone to form a reboiling liquid;

(8) partially vaporizing the reboiling liquid in the reboiling zone to form a vapor, and a liquid krypton-xenon concentrate having a low concentration of oxygen;

(9) passing the vapor formed in step (8) up the exchange column to form part of the upflowing exchange vapor; and

(10) recovering substantially oxygen-free krypton-xenon concentrate.

As used herein, the term "oxygen-free" means having an oxygen concentration of no more than 2 percent and preferably no more than 1 percent.

As used herein, the term "low concentration" means a concentration of no more than 2 percent.

As used herein, the term "indirect heat exchange" means the bringing of two fluid streams into heat exchange relation without any physical contact or intermixing of the fluids with each other.

As used herein, the term "equilibrium stage" means a vapor-liquid contacting stage whereby the vapor and liquid leaving that stage are in mass transfer equilibrium. For a separation column that uses trays or plates, i.e. separate and discrete contacting stages for the liquid and gas phases, an equilibrium stage would correspond to a theoretical tray or plate. For a separation column that uses packing, i.e. continuous contacting of the liquid and gas phases, an equilibrium stage would correspond to that height of column packing equivalent to one theoretical plate. An actual contacting stage, i.e. trays, plates, or packing, would have a correspondence to an equilibrium stage dependent on its mass transfer efficiency.

As used herein, the term "column" means a distillation or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of fractionation columns see the Chemical Engineer's Handbook, Fifth Edition, edited by R. H. Perry and C. H. Chilton, McGraw-Hill Book Company, New York Section 13, "Distillation" B. D. Smith et al, page 13-3, *The Continuous Distillation Process*.

The term "double column" is used herein to mean a high pressure column having its upper end in heat exchange relation with the lower end of a low pressure column. An expanded discussion of double columns appears in Ruheman, "The Separation of Gases" Oxford University Press, 1949, Chapter VII, Commercial Air Separation, and Barron, "Cryogenic Systems", McGraw-Hill, Inc., 1966, p. 230, Air Separation Systems.

As used herein, the term "rare gas" means krypton or xenon.

As used herein, the term "reboiling zone" means a heat exchange zone where entering liquid is indirectly heated and thereby partially vaporized to produce gas and remaining liquid. The remaining liquid is thereby enriched in the less volatile components present in the entering liquid.

As used herein, the term "exchange column" means a column wherein oxygen in a krypton-xenon concentrate is replaced with a non-oxygen medium.

As used herein, the term "reflux ratio" means the numercial ratio of descending liquid and rising vapor flow in a column.

BRIEF DESCRIPTION OF THE DRAWING

The FIGURE is a schematic flow diagram of one preferred embodiment of the process of this invention wherein the same rare gas-free vapor is employed as the upflowing exchange vapor and to drive the reboiler, with a portion of the liquid resulting from the reboiler condensation being used as the reflux liquid.

DETAILED DESCRIPTION

The process of this invention will be described in detail with reference to FIG. 1.

Referring now to the FIGURE, feed liquid 18 comprising oxygen, krypton and xenon is introduced into column 10 at an intermediate point of the column and flows downward through the column. The feed liquid 18 may have any effective concentration of krypton and xenon and generally will have a krypton concentration of at least 100 ppm and a xenon concentration of at least 7 ppm. Also introduced into column 10, at a point below the aforesaid intermediate point is vapor 35 which has a low concentration of rare gases and oxygen. Vapor 35 is employed as upflowing exchange vapor in column 10. The FIGURE illustrates a preferred embodiment of this invention wherein low pressure nitrogen, such as from the low pressure column of a double column air separation plant or from a nitrogen pipeline or nitrogen storage facility, is employed as the source of some of the vapor 35. In this preferred embodiment, low pressure nitrogen gas 17 is compressed by compressor 15 and the compressed stream 21 is cooled by indirect heat exchange through heat exchanger 16 so as to be, as stream 22, close to its saturated temperature at the pressure it has been compressed to. Stream 22 is divided into two streams, 32 and 23. Stream 32 is expanded through valve 33 and, as stream 34, is combined with vapor 31 from reboiler 14 to form vapor 35 to be used as upflowing exchange vapor in column 10. Stream 23 is passed to condenser 13 within reboiler 14 wherein it is condensed against partially vaporizing reboiling liquid. The condensed nitrogen stream 24 is passed out of condenser 13 and removed from the process as stream 20 and is suitable for use in any application requiring liquid nitrogen.

Above the aforementioned intermediate point there is introduced into column 10 liquid reflux 27 for downflow through the column. This liquid reflux 27 is substantially free of rare gases and preferably substantially free of oxygen. Preferably the maximum krypton concentration of reflux liquid 27 is 3 ppm and the maximum xenon concentration is 0.2 ppm. One source for liquid reflux 27 is liquid air. As mentioned, the FIGURE illustrates a preferred embodiment wherein reflux liquid 27 is obtained from condensed nitrogen stream 24. In this preferred embodiment, a fraction 25 of stream 24, comprising from 10 to 50 percent of stream 24 is expanded through valve 26 and introduced into the top of column 10 as downflowing reflux liquid 27.

As can be seen from the FIGURE, column 10, which operates at a pressure in the range of from 15 to 75 psi and preferably in the range of from 15 to 30 psi, is composed of two sections, 11 and 12. Although shown schematically in the FIGURE as having two distinct parts, those skilled in the art recognize that in practice, column 10 would be a single column with a side feedstream. The FIGURE schematic is to more clearly describe the process of this invention.

Downflowing reflux liquid 27 flows through top section 11 and then combines as stream 28 with feed liquid 18 to form downflowing liquids 29 which flow down through bottom section 12 against upflowing exchange vapor. Within section 12 during this countercurrent liquid-vapor flow, oxygen from the downflowing liquids is passed into the upflowing exchange vapor and non-oxygen medium, which is nitrogen in the preferred embodiment, is passed from the upflowing exchange vapor into the downflowing liquids.

The now oxygen-containing upflowing vapor 36 passes up through top secton 11 wherein it passes against the downflowing liquid reflux 27. This step serves to transfer krypton and xenon, which may have been passed into the upflowing vapor during the mass exchange which occurred in bottom section 12, into downflowing liquid reflux 27 which was introduced into column 10 substantially free of rare gases. In this way very little, if any, of the krypton and xenon introduced into column 10 with feed 18 is removed from the process other than as part of the desired krypton-xenon concentrate.

The exchange processes that occur in column sections 11 and 12 are dependent on the usual tendency of gas and liquid phases in contact with each other to be driven towards mass transfer equilibrium while maintaining the system heat balance. Since the entering liquid at the top of the column section 12 is primarily oxygen and the entering vapor at the bottom of the column section 12 is non-oxygen, typically nitrogen, the exchange action in the column will be to transfer the oxygen into the rising vapor while the falling liquid increases in the non-oxygen component. The extent of this mass transfer exchange will depend on the relative amounts of the entering liquid and vapor, the purity of the feed streams, and the number of phase contact stages within the column, as is well known in the art.

Since the entering upflowing vapor, or stripping gas, is substantially free of or low in oxygen, the result is that most of the oxygen is transferred to the rising vapor and exits with the overhead vapor. Likewise, similar transfer occurs for the rare gases so that the vapor leaving section 12 contains substantial krypton-xenon content, although to a lesser extent than the oxygen since the vapor pressure of the krypton and xenon is considerably less that that of oxygen. Nevertheless, the rare gas content of that vapor would represent a significant loss. Accordingly, the addition of another column section 11 refluxed with low rare gas content liquid serves to recapture rare gas which might be lost with the overhead vapor of column section 11.

The oxygen-containing upflowing vapor, which is substantially free of rare gases, is removed from column 10 as stream 37. In the preferred embodiment of FIG. 1, stream 37 is warmed through heat exchanger 16 to effect the aforedescribed cooling of compressed nitrogen stream 21. This step aids in efficiency by recapturing some refrigeration back into the process. The warmed stream 38 is passed from heat exchanger 16 and out of the process.

The downflowing liquids which have passed through section 12 and which contain very little oxygen are passed 20 into reboiling zone 14 to form reboiling liquid 40. Herein the reboiling liquid 40 is partially vaporized to form a vapor and a krypton-xenon concentrate. This step serves to further concentrate the krypton and xenon. This vapor 31 is passed up column 10 and forms part of the upflowing exchange vapor.

In the preferred embodiment of the FIGURE, reboiling liquid 40 is partially vaporized by heat exchange with condensing saturated nitrogen 23 and the resulting vapor 31 is combined with nitrogen stream 34 to form vapor stream 35 which is introduced into the column to form the upflowing exchange vapor.

As was discussed with reference to column sections 11 and 12, reboiling zone 14, although shown for purposes of clarity as separate from column 10, may in actuality be within a single column apparatus with sections 11 and 12.

Krypton-xenon liquid concentrate 19 is recovered from reboiling zone 14 containing essentially all of the krypton and xenon introduced into the process with feed 18 and containing very little oxygen so as to be substantially oxygen-free. The maximum oxygen concentration in stream 19 would be only about 2 percent and preferably only about 1 percent. Although the absolute concentration of krypton and xenon in product stream 19 will depend on the concentration of these gases in the feed, the concentration of krypton in stream 19 will be at least about 20 times, and the concentration of xenon will be at least about 20 times, that which they were in the feed.

In Table I there is tabulated the results of a computer simulation of the process of this invention carried out in accord with the FIGURE embodiment. The data is presented for illustrative purposes and is not intended to be limiting. The abbreviations "CFH" and "PSIA" refer respectively to "cubic feet per hour", measured at ambient temperature (70° F.) and atmospheric pressure (14.7 psia), and "pounds per square inch absolute". The stream numbers correspond to those of FIG. 1 and the percentages are in mole percent or parts per million volume (ppm).

TABLE I

| | Stream No. | | | | | | | | |
|---|---|---|---|---|---|---|---|---|---|
| | 17 | 18 | 19 | 20 | 25 | 30 | 31 | 36 | 38 |
| Flow, CFH | 5520 | 1000 | 30 | 620 | 340 | 1580 | 1550 | 5830 | 5870 |
| Temperature, °K. | 300 | 93 | 80 | 82 | 82 | 80 | 80 | 84 | 292 |
| Pressure, PSIA | 15 | 19 | 20 | 24 | 24 | 20 | 20 | 19 | 16 |
| Purity | | | | | | | | | |
| Nitrogen, Percent | 100 | — | 97.1 | 100 | 100 | 99.0 | 99.1 | 80.3 | 82.9 |
| Oxygen, Percent | — | 99.5 | 0.8 | — | — | 0.8 | 0.7 | 19.6 | 17.0 |
| Other, Percent | — | 0.4 | 0.4 | — | — | 0.1 | 0.2 | 0.1 | 0.1 |
| Krypton, PPM or Percent | — | 443 | 1.5% | — | — | 763 | 492 | 32 | 0.7 |
| Xenon, PPM or Percent | — | 38 | 0.2% | — | — | 27 | 3 | 0.3 | <0.1 |

Now, by the use of the process of this invention, one can process a liquid stream containing oxygen, krypton and xenon, such as one might obtain from a double column air separation plant, so as to further concentrate the krypton and xenon for economical recovery and so as to recover the krypton-xenon concentrate substantially free of oxygen while recovering substantially all of the rare gases in the feed liquid as part of the rare gas concentrate. Thus the process of this invention can be economically operated separate from a comprehensive air separation plant and furthermore does not require burdening such a plant with a rare gas-containing input stream.

Although the process of this invention has been described in detail with reference to a particularly preferred embodiment it can be appreciated that there are other embodiments within the spirit and scope of the claims.

I claim:

1. A method for processing a liquid feed comprising krypton, xenon and oxygen to produce krypton and xenon concentrated in a substantially oxygen-free medium whereby substantially all of the krypton and xenon in the feed is concentrated in said medium comprising:

(1) introducing a feed liquid comprising oxygen, krypton and xenon into an exchange column at an intermediate point of the column for downward flow through the column;

(2) introducing vapor, having a low concentration of oxygen and rare gases, into said exchange column at a point below said intermediate point to form upflowing exchange vapor;

(3) introducing substantially rare gas-free liquid into said column at a point above said intermediate point to form downflowing reflux liquid;

(4) passing the upflowing vapor against the downflowing liquids to exchange oxygen from the downflowing liquids to the upflowing vapor and non-oxygen medium from the upflowing vapor to the downflowing liquids;

(5) passing the oxygen-containing upflowing vapor against downflowing liquid reflux whereby krypton and xenon which may have passed to the upflowing vapor during step (4) are transferred into downflowing liquid;

(6) removing from the exchange column the oxygen-containing vapor substantially free of rare gases;

(7) passing the downflowing liquids to a reboiling zone to form a reboiling liquid;

(8) partially vaporizing the reboiling liquid in the reboiling zone to form a vapor, and a liquid krypton-xenon concentrate having a low concentration of oxygen;

(9) passing the vapor formed in step (8) up the exchange column to form part of the upflowing exchange vapor; and

(10) recovering substantially oxygen-free krypton-xenon concentrate.

2. The method of claim 1 wherein in step (2) said vapor which has a low concentration of oxygen and rare gases is nitrogen.

3. The method of claim 2 wherein said nitrogen is taken from a cryogenic air separation plant.

4. The method of claim 3 wherein the said nitrogen is taken from the lower pressure column of a double column cryogenic air separation plant.

5. The method of claim 1 wherein in step (3) said substantially rare gas-free liquid is nitrogen.

6. The method of claim 1 wherein the reboiling liquid is partially vaporized by heat exchange with gaseous nitrogen which condenses to form liquid nitrogen.

7. The method of claim 6 wherein a portion of the liquid nitrogen is employed as the substantially rare gas-free liquid of step (3).

8. The method of claim 1 wherein gaseous nitrogen from a cryogenic air separation plant is compressed and cooled, one part is employed as the vapor which has a low concentration of oxygen and rare gases of step (2), and a second part is condensed to partially vaporize the reboiling liquid.

9. The method of claim 8 wherein a portion of the condensed second part is employed as the substantially rare gas free liquid of step (3).

10. The method of claim 8 wherein the oxygen-containing vapor removed from the exchange column in step (6) is warmed to cool the compressed gaseous nitrogen.

11. The method of claim 1 wherein said feed liquid contains at least 100 ppm krypton.

12. The method of claim 1 wherein said feed liquid contains at least 7 ppm xenon.

13. The method of claim 1 wherein the concentration of krypton in the liquid krypton-xenon concentrate is at least 20 times the concentration of krypton in the feed liquid.

14. The method of claim 1 wherein the concentration of xenon in the liquid krypton-xenon concentrate is at least 20 times the concentration of xenon in the feed liquid.

15. The method of claim 1 wherein said exchange column is operating at a pressure in the range of from 15 to 75 psia.

16. The method of claim 1 wherein the oxygen concentration in the substantially oxygen-free krypton-xenon concentrate does not exceed 2 percent.

17. The method of claim 1 wherein the substantially rare gas-free liquid which forms downflowing reflux liquid is introduced into the column at the top of the column.

18. The method of claim 1 wherein the substantially rare gas-free liquid which forms downflowing reflux liquid is liquid air.

* * * * *

UNITED STATES PATENT AND TRADEMARK OFFICE

CERTIFICATE OF CORRECTION

PATENT NO. : 4,647,299

DATED : March 3, 1987

INVENTOR(S) : Harry Cheung

It is certified that error appears in the above-identified patent and that said Letters Patent is hereby corrected as shown below:

In column 3, line 53 delete "FIG. 1" and insert therefor --the FIGURE--.

In column 6, line 16 delete "FIG. 1" and insert therefor --the FIGURE--.

Signed and Sealed this

Eighteenth Day of August, 1987

*Attest:*

DONALD J. QUIGG

*Attesting Officer*

*Commissioner of Patents and Trademarks*